US009010698B2

(12) United States Patent
Bowman

(10) Patent No.: US 9,010,698 B2
(45) Date of Patent: Apr. 21, 2015

(54) GIFT BAG HOLDER

(75) Inventor: Linden H. Bowman, Ellicott City, MD (US)

(73) Assignee: The Lindy Bowman Company, Elkridge, MD (US)

( * ) Notice: Subject to any disclaimer, the term of this patent is extended or adjusted under 35 U.S.C. 154(b) by 220 days.

(21) Appl. No.: 13/596,895

(22) Filed: Aug. 28, 2012

(65) Prior Publication Data

US 2014/0061418 A1 Mar. 6, 2014

(51) Int. Cl.
*B65D 33/14* (2006.01)
*B65D 73/00* (2006.01)

(52) U.S. Cl.
CPC ..... *B65D 73/0064* (2013.01)

(58) Field of Classification Search
CPC .... B65D 33/14; A47F 5/0006; Y10S 206/806
USPC ..... 383/6, 25; 294/137, 159; 206/449; 248/95, 99, 223.21, 225.21, 220.31, 248/300, 247
See application file for complete search history.

(56) References Cited

U.S. PATENT DOCUMENTS

| | | | | | |
|---|---|---|---|---|---|
| 3,096,009 | A | * | 7/1963 | Jang | 223/87 |
| 3,310,272 | A | | 3/1967 | Brunger | |
| 3,339,824 | A | * | 9/1967 | Luke | 383/25 |
| 4,027,842 | A | | 6/1977 | Mittleman | |
| 4,154,383 | A | * | 5/1979 | Honatzis | 224/556 |
| 4,608,283 | A | * | 8/1986 | White | 428/4 |
| 4,696,050 | A | * | 9/1987 | Sengewald | 383/10 |
| 4,809,353 | A | * | 2/1989 | Cheng | 383/6 |
| 4,946,065 | A | | 8/1990 | Goulter et al. | |
| 5,044,773 | A | * | 9/1991 | Harms et al. | 383/22 |
| 5,226,734 | A | | 7/1993 | Scott et al. | |
| 5,390,794 | A | * | 2/1995 | Vulpitta | 206/459.1 |
| 5,593,025 | A | * | 1/1997 | Feibelman | 206/6.1 |
| 5,788,080 | A | * | 8/1998 | Sill et al. | 206/554 |
| 6,053,325 | A | * | 4/2000 | Yonker et al. | 206/736 |
| 6,073,758 | A | * | 6/2000 | Webster et al. | 206/6.1 |
| 6,145,665 | A | * | 11/2000 | Krahn | 206/756 |
| 6,155,521 | A | * | 12/2000 | O'Hanlon | 248/99 |
| 6,305,597 | B1 | * | 10/2001 | Donegan et al. | 229/117.22 |
| 7,318,568 | B2 | | 1/2008 | Barouta | |
| 7,987,989 | B2 | * | 8/2011 | Abell | 206/777 |
| 8,474,163 | B2 | * | 7/2013 | Rubin | 40/124.06 |
| 2002/0092958 | A1 | | 7/2002 | Lusk | |
| 2004/0099564 | A1 | * | 5/2004 | Leifeld et al. | 206/528 |
| 2004/0195298 | A1 | * | 10/2004 | Schultz et al. | 229/117.14 |
| 2005/0157956 | A1 | * | 7/2005 | Geyer | 383/5 |
| 2005/0173600 | A1 | | 8/2005 | Morris | |
| 2005/0268507 | A1 | * | 12/2005 | Valiulis et al. | 40/651 |
| 2006/0013513 | A1 | * | 1/2006 | Meyer | 383/25 |
| 2006/0029298 | A1 | * | 2/2006 | Arends et al. | 383/37 |
| 2006/0196787 | A1 | * | 9/2006 | Lewis | 206/232 |

(Continued)

*Primary Examiner* — Terrell McKinnon
*Assistant Examiner* — Eret McNichols
(74) *Attorney, Agent, or Firm* — Cahn & Samuels, LLP

(57) ABSTRACT

An embodiment of the invention provides a device for holding an article, wherein the device includes a front panel including a first aperture positioned above a second aperture. The first aperture is dimensioned to receive a display hook; and, the second aperture is dimensioned to receive and retain the article. A rear panel is hingedly connected to the front panel, wherein the rear panel includes a third aperture positioned above at least one fourth aperture. The third aperture is dimensioned to receive the display hook; and, the fourth aperture is dimensioned to receive and retain a second article. The device further includes a card removably connected to the rear panel via perforations.

19 Claims, 4 Drawing Sheets

(56) References Cited

U.S. PATENT DOCUMENTS

2009/0010574 A1* 1/2009 Prescott ..... 383/23
2009/0091123 A1* 4/2009 Conley et al. ..... 283/106
2010/0213092 A1* 8/2010 Swain ..... 206/459.5
2010/0224516 A1* 9/2010 Abell ..... 206/307
2011/0108612 A1* 5/2011 Nickell et al. ..... 229/75
2011/0233347 A1 9/2011 Turvey et al.
2011/0253567 A1* 10/2011 Cossey ..... 206/287
2013/0043156 A1* 2/2013 Glass ..... 206/449

* cited by examiner

GIFT BAG HOLDER

I. DESCRIPTION OF THE TECHNICAL FIELD

This invention relates to an improvement in devices for retaining gift bags, pouches, sacks, and other like articles, and more particularly to a gift bag holder having apertures for receiving and retaining articles and a display hook therein.

II. BACKGROUND OF THE INVENTION

In recent years, there has been a tremendous growth in the manufacture and sale of containers, particularly decorative containers for receiving and holding objects, such as gift objects. One form of such containers is a decorative bag that is adapted to receive a gift item, which eliminates the need to place the items in separate boxes that are usually subsequently wrapped with gift wrapping paper. Instead, gift items may be "wrapped" in the bag and hidden from view using such items as tissue paper, confetti, bag stuffing, shredded ribbons, and the like. Typically these decorative or gift bags have ornamental designs on their surface containing indicia relating to a season, event or in some way relevant and/or endearing to the intended recipient of the gift.

U.S. Patent Application Publication No. 2002/0092958 to Lusk discloses a hanger for the hanging and display of novelties and articles which are usually hung from the interior rearview mirror or rearview mirror support post of an automobile. The demountable hanger includes an inverted hook assembly located at the top of the hanger, wherein the hook provides a means for suspending the hanger from the horizontal support post, and wherein the support post is supporting the rearview mirror from the automobile windshield. A plurality of attachment means is located along and above the bottom of the hanger, wherein the attachments are comprised of inverted U-shaped tab members, and wherein such members are adapted to hang a plurality of novelties therefrom.

U.S. Patent Application Publication No. 2005/0173600 to Morris discloses a device for suspending and supporting various items including ice cubes or the like in common ice chests. The device is comprised of an assembly of components including flexible fabric that is supported at its borders by a rigid frame or elastic frame, which is then attached to the ice chest with mounting components that are installed by the consumer or molded to the ice chest body during manufacturing. Items are placed on top of the fabric located at or near the top of the ice chest preventing the items from failing to the bottom of the ice chest where they may be damaged.

U.S. Patent Application Publication No. 2009/0010574 to Prescott discloses a gift bag hanger including a hooking portion, a body, and at least one flap to display gift bags or similar items on a merchandise rack. The hangers may have one or more flaps to maintain the gift bag in the closed position. When the hanger has one flap, the hanger is attached to one side of the gift bag, and the flap engages the opposite side of the bag. By closing the bag, the flap provides enhanced support and stability for the bag. When the hanger has more than one flap, it can be attached to one side of the gift bag using one flap, and a second flap can engage the opposite side of the bag to keep it closed.

U.S. Patent Application Publication No. 2011/0233347 to Turvey et al. discloses a two-piece hanger for hanging a bag filled with contents without puncturing the bag that holds the bag between the two pieces with a cleat-and-groove connection. The hanger includes a hanger piece for hanging from a support and a clamping piece that is removably attachable to the hanger piece. The hanger piece includes a hanger mechanism and a cleat. The clamping piece includes a body having an upper surface and a slotted grove receptor. The clamping piece is removably connected to the hanger piece by inserting the head of the cleat into the slotted grove receptor, whereby the cleat locks the clamping piece to the body of the hanger member in a cleat-and-groove arrangement.

U.S. Patent Application Publication No. 2011/0253567 to Cossey discloses a gift bag that includes a top panel having a centrally located slot formed therein, a bag body extending downward from the top panel to form a substantial enclosure, and a reinforcing material adjacent the top panel. The reinforcing material is placed so as to not interfere with said centrally located slot and the slot is sized to allow a rod engaging member of a hanger to pass therethrough.

III. SUMMARY OF THE INVENTION

The invention relates to a device for retaining and displaying gift bag containers having a novel structure.

It is an object of the invention to provide a device for displaying the gift bag containers, and particularly for presenting the gift bag containers to consumers in a retail environment.

It is another object of the invention to provide a device for storing articles, particularly thin, flexible, and foldable articles.

It is yet another object of the invention to provide a device for hanging the articles on, for example, a sales rack and maintaining the articles at a select height for improved physical and visual accessibility.

It is still another object of the invention to provide a device for hanging the articles for storage, wherein multiple devices can be utilized to stow articles in an organized manner.

Certain of these and other objects are satisfied by a device for holding an article, wherein the device includes a front panel and a rear panel, wherein the front panel has a first aperture positioned above a second aperture. The first aperture is dimensioned to receive a display hook; and, the second aperture is dimensioned to receive and retain the article. Specifically, the second aperture can be in the form of an elongated slit dimensioned to receive and retain a thin, flexible article.

The rear panel is hingedly connected to the front panel, wherein the height of the rear panel can be at least three times greater than the height of the front panel. The rear panel includes a third aperture positioned above at least one fourth aperture. The third aperture is dimensioned to receive the display hook. Specifically, the third aperture is substantially equal in size and shape to the first aperture, wherein the third aperture is aligned with the first aperture when the device is in a folded configuration.

The at least one fourth aperture is dimensioned to receive and retain a second article. The at least one fourth aperture can include a first opening and a second opening, wherein the first and second openings are each dimensioned to receive and retain a drawstring for the article. The device can also include a card removably connected to the rear panel via perforations.

For definitional purposes and as applicable, the term "hook" or "display hook" as used herein is intended to mean an apparatus for hanging items thereon, wherein the "hook" may be in the form of a rack, bar, rod, dowel or other like apparatus.

As used herein, the term "panel" is intended to mean a thin sheet of material having two opposing flat surfaces, which may be in the form of a board or pane.

As used herein, the term "aperture" is intended to mean a feed-through dimensioned to receive and retain a display hook or article therein, which may be in the form of a hole, opening, orifice, pass-through, passage, perforation, slit, slot, and the like.

As used herein, the singular forms "a", "an", and "the" are intended to include the plural forms as well, unless the context clearly indicates otherwise.

As used herein "substantially," "generally," and other words of degree are relative modifiers intended to indicate permissible variation from the characteristic so modified. It is not intended to be limited to the absolute value or characteristic which it modifies but rather possessing more of the physical or functional characteristic than its opposite, and preferably, approaching or approximating such a physical or functional characteristic.

In the following description, reference is made to the accompanying drawing which is shown by way of illustration to the specific embodiments in which the invention may be practiced. The following illustrated embodiments are described in sufficient detail to enable those skilled in the art to practice the invention. It is to be understood that other embodiments may be utilized and that structural changes based on presently known structural and/or functional equivalents may be made without departing from the scope of the invention.

IV. BRIEF DESCRIPTION OF THE DRAWING

V. DETAILED DESCRIPTION OF THE EMBODIMENTS

Referring now to the figures, wherein like reference numbers denote like components, elements, or features through the various illustrated embodiments discussed in detail below, the invention is a device including a container and a strap. While specific implementations of the disclosed technology are discussed, it should be understood that this is done for illustration purposes only. A person skilled in the relevant art will recognize that other components and configurations may be used without departing from the spirit and scope of the invention.

FIGS. 1-4 illustrate a device 100 for retaining and displaying articles according to an embodiment of the invention, wherein the device 100 (also referred to herein as a "gift bag holder") includes a front panel 110 and a rear panel 120. The front panel 110 and rear panel 120 can be formed from a generally rigid or a semi-rigid material, such as, for example, cardboard or plastic. In at least one embodiment, the device 100 is formed from a single sheet of material that is folded to form the front panel 110 and rear panel 120. Thus, the front panel 110 can be hingedly connected to the rear panel 120, wherein a top of the front panel 110 is in communication with a top of the rear panel 120.

Figure 1:
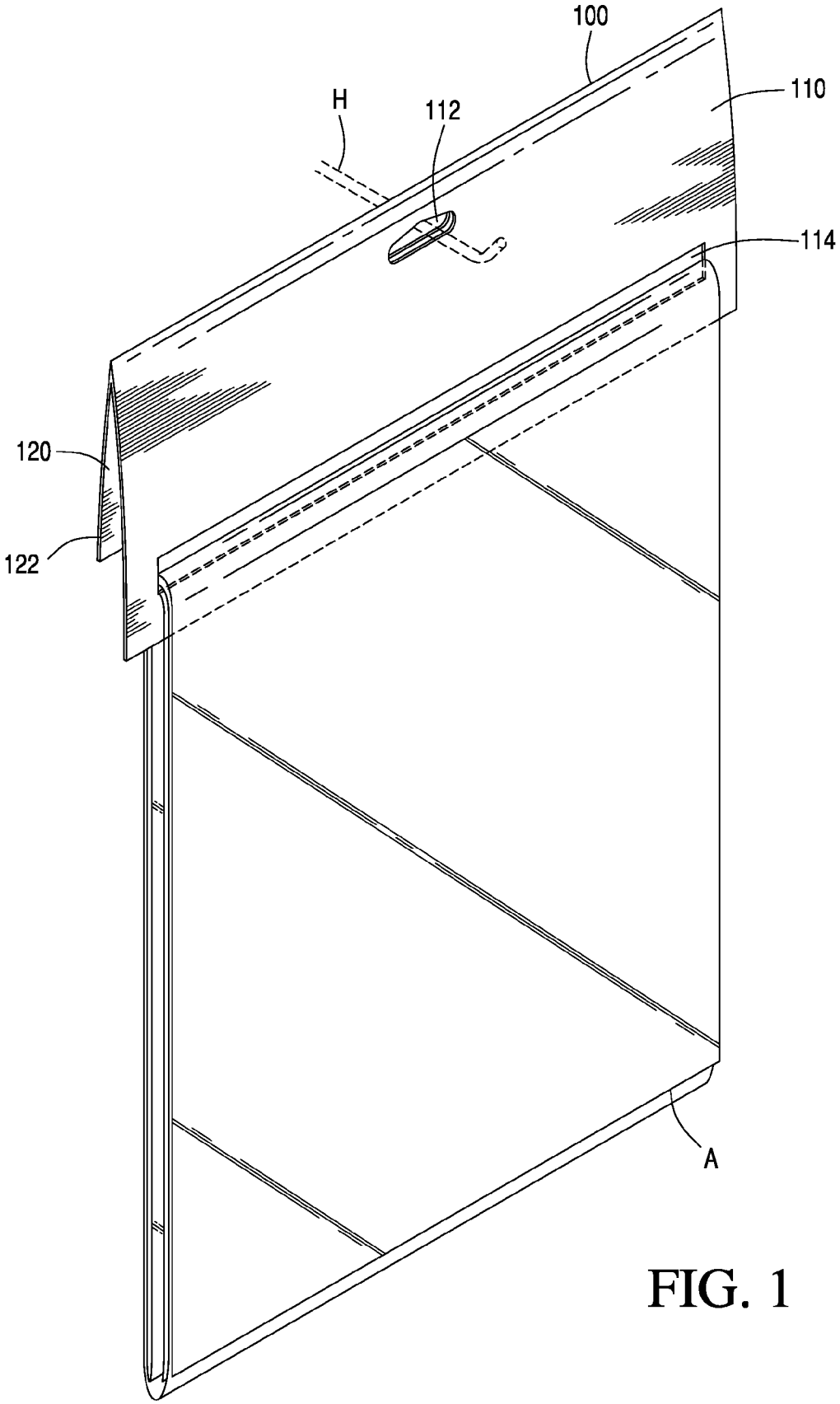
FIG. 1 is a front perspective view showing a gift bag holder, gift bag, and display hook according to an embodiment of the invention.
Figure 3:
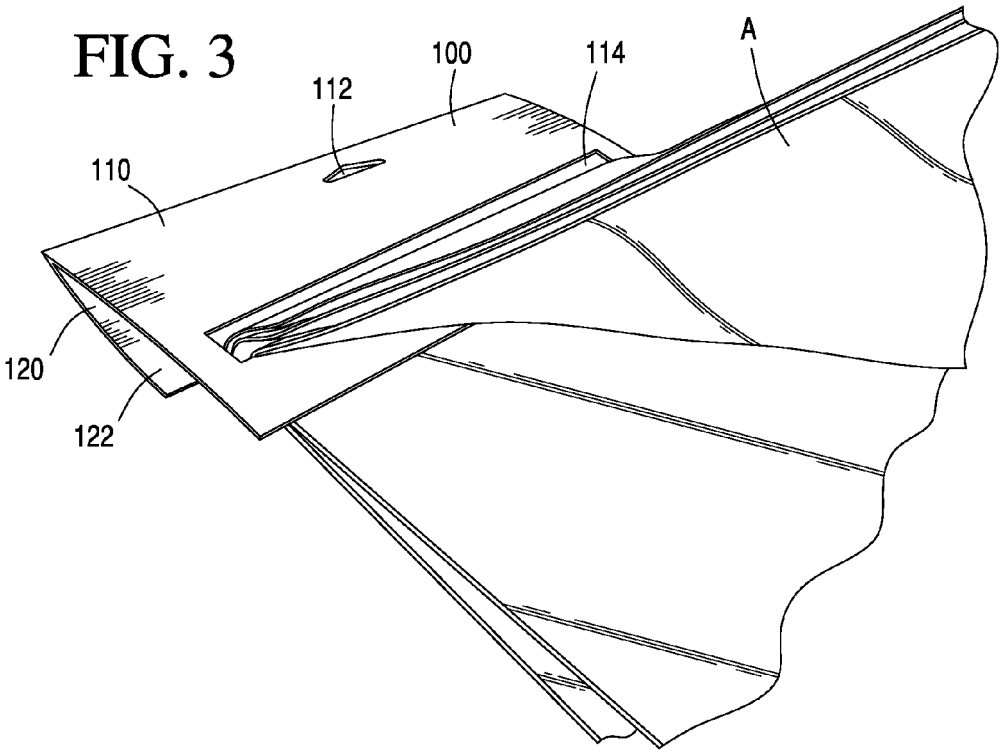
FIG. 3 is a top perspective view showing a gift bag holder and gift bag lying on a flat surface according to an embodiment of the invention.

As illustrated in FIGS. 1 and 3, the front panel 110 can be rectangular shaped and includes a first aperture 112 and a second aperture 114. Although the FIGS. illustrate that the first aperture 112 is triangular-shaped, it is contemplated in other embodiments that the first aperture 112 could comprise other shapes, such as circular, semi-circular, oblong, etc. As illustrated in FIG. 1, the first aperture 112 is dimensioned to receive and retain a portion of a display hook H therein, such that the display hook H passes through the first aperture 112 and secures the device 100 and its contents thereon via friction.

The second aperture 114 is dimensioned to receive and retain one or more articles therein. As illustrated in FIGS. 1 and 3, the second aperture 114 can be an elongated slit dimensioned to receive and retain a thin, flexible article A, such as, for example, a towel, sheet, or plastic bag or sack that is folded and hung from the second aperture 114. The second aperture 114 can be positioned below the first aperture 112 so that the article A can hang downward and away from the display hook H without obstruction.

Figure 2:
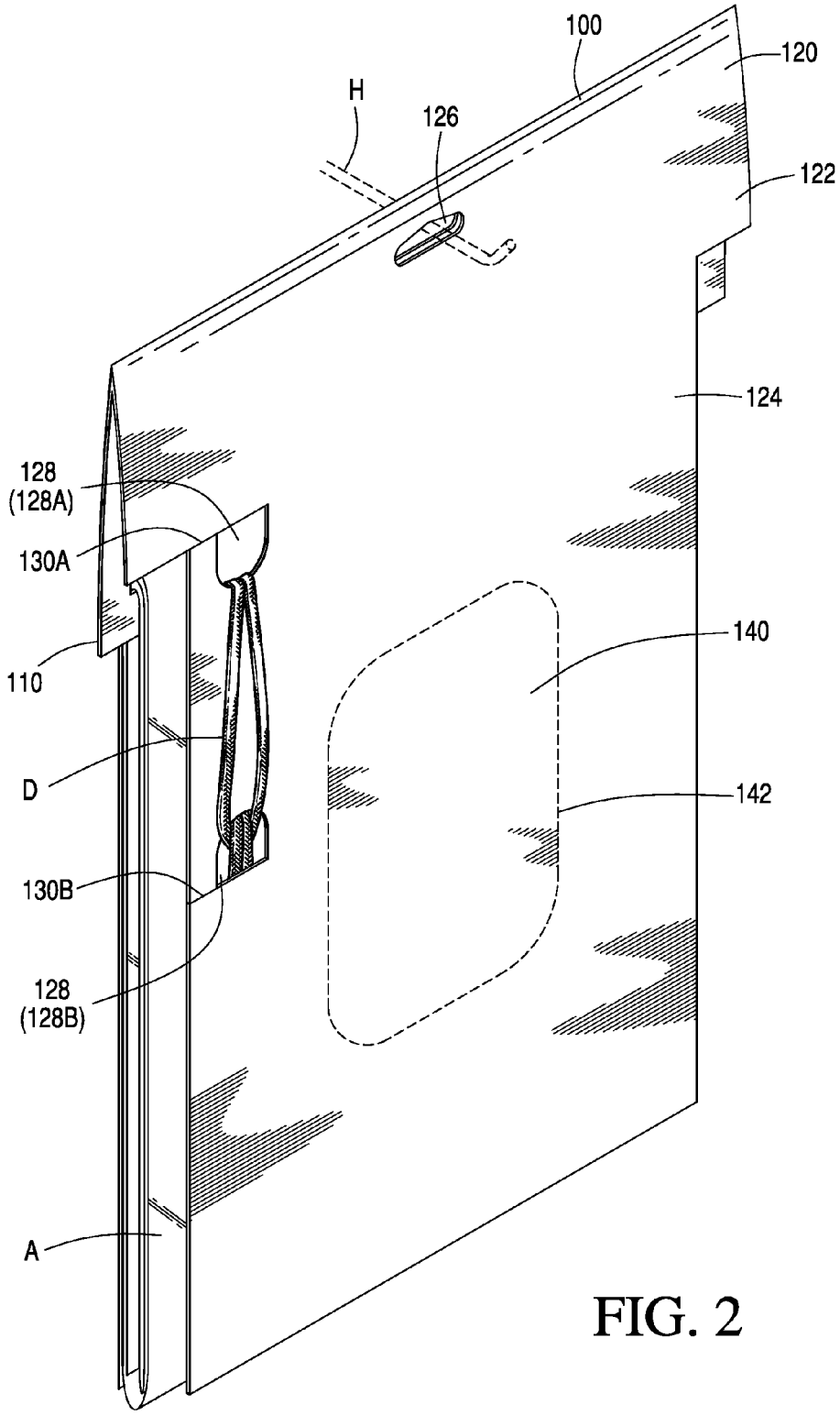
FIG. 2 is a right rear perspective view showing a gift bag holder, gift bag, display hook, and drawstring according to an embodiment of the invention.
Figure 4:
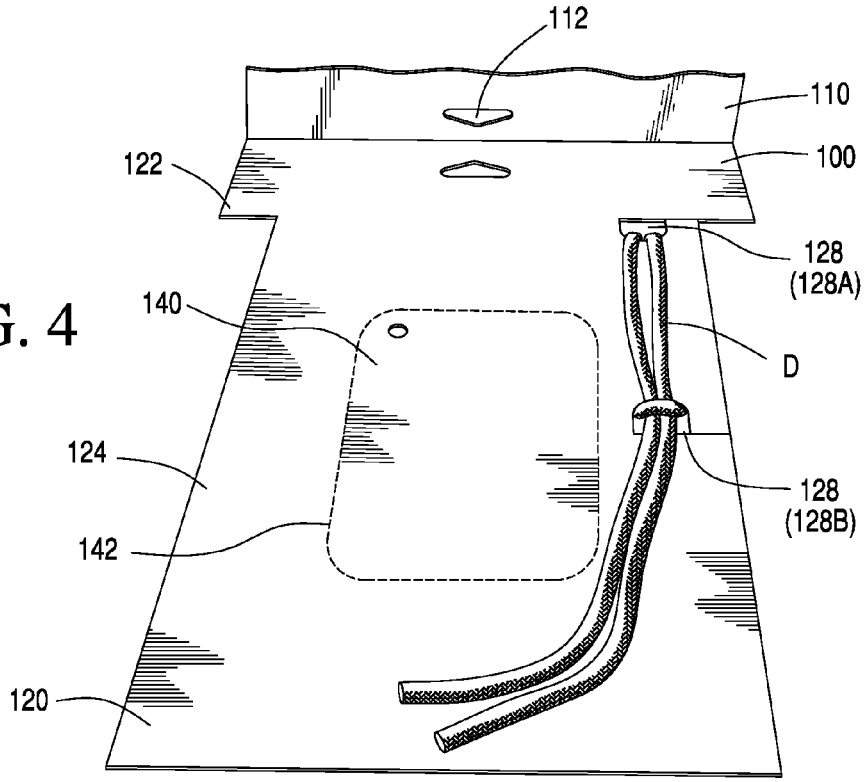
FIG. 4 is a top perspective view showing a gift bag holder and drawstring lying on a flat surface according to an embodiment of the invention, wherein a front panel of the gift bag is lifted upwards and away from a rear panel of the gift bag.

As illustrated in FIGS. 2 and 4, in at least one embodiment, the rear panel 120 is T-shaped and includes an upper rectangular section 122 in communication with a lower rectangular section 124. In another embodiment, the rear panel 120 is a single rectangular panel. The rear panel 120 includes a third aperture 126 and at least one fourth aperture 128, wherein the third aperture 126 can be positioned above the fourth aperture 128.

As illustrated in FIGS. 1-2, the third aperture 126 is substantially equal in size and shape to the first aperture 112, wherein the third aperture 126 is aligned with the first aperture 112 when the device 100 is in a folded configuration. The third aperture 126 is dimensioned to receive and retain a portion of the display hook H therein, such that the display hook H passes through the third aperture 126 and the first aperture 112 when the device 100 is in a folded configuration, wherein the display hook H secures the device 100 and its contents thereon via friction.

Although the FIGS. illustrate that the first aperture 112, second aperture 114, and third aperture 126 are fully enclosed by the material of the front panel 110 and rear panel 120, it is contemplated in other embodiments that the first aperture 112, second aperture 114, and/or third aperture 126 are not fully enclosed holes. Rather, the first aperture 112, second aperture 114, and/or third aperture 126 can be open-ended cutouts, such as, for example, a J-shaped cutout for hanging the device 100 on a display hook.

The fourth aperture 128 is dimensioned to receive and retain a second article. In at least one embodiment, the fourth aperture 128 includes a first opening 128A and a second opening 128B dimensioned to receive and retain a second article for use with the article A. For example, as illustrated in FIGS. 2 and 4, a drawstring/handle D for use with the article A is removably secured within the first opening 128A and second opening 128B.

In at least one embodiment, the rear panel 120 includes a first slit 130A and a second slit 130B, wherein the first slit 130A and second slit 130B connect the first opening 128A and second opening 128B, respectively, to an outer edge of the rear panel 120. Thus, the second article (e.g., drawstring/handle D) can be inserted to the first opening 128A and second opening 128B via insertion into the first slit 130A and second slit 130B, respectively. In another embodiment, the rear panel 120 lacks the first slit 130A and second slit 130B, wherein the first opening 128A and second opening 128B are fully enclosed by the material of the rear panel 120. In this embodiment, the second article can be attached to the device 100 by inserting the second article directly into the first opening 128A and second opening 128B.

In at least one embodiment of the invention, the rear panel 120 also incorporates an integrated removable card 140. As illustrated in FIGS. 2 and 4, the rear panel includes perforations 142 outlining the card 140. As such, tearing or breaking of the perforations 142 allows for the removal of the card 140 from the rear panel 120. The card 140 can be decorative such that when the device 100 is used as a gift bag holder, the card 140 includes an area for filling out the names of the recipient(s) of the gift and/or the sender(s) of the gift.

Figure 5:
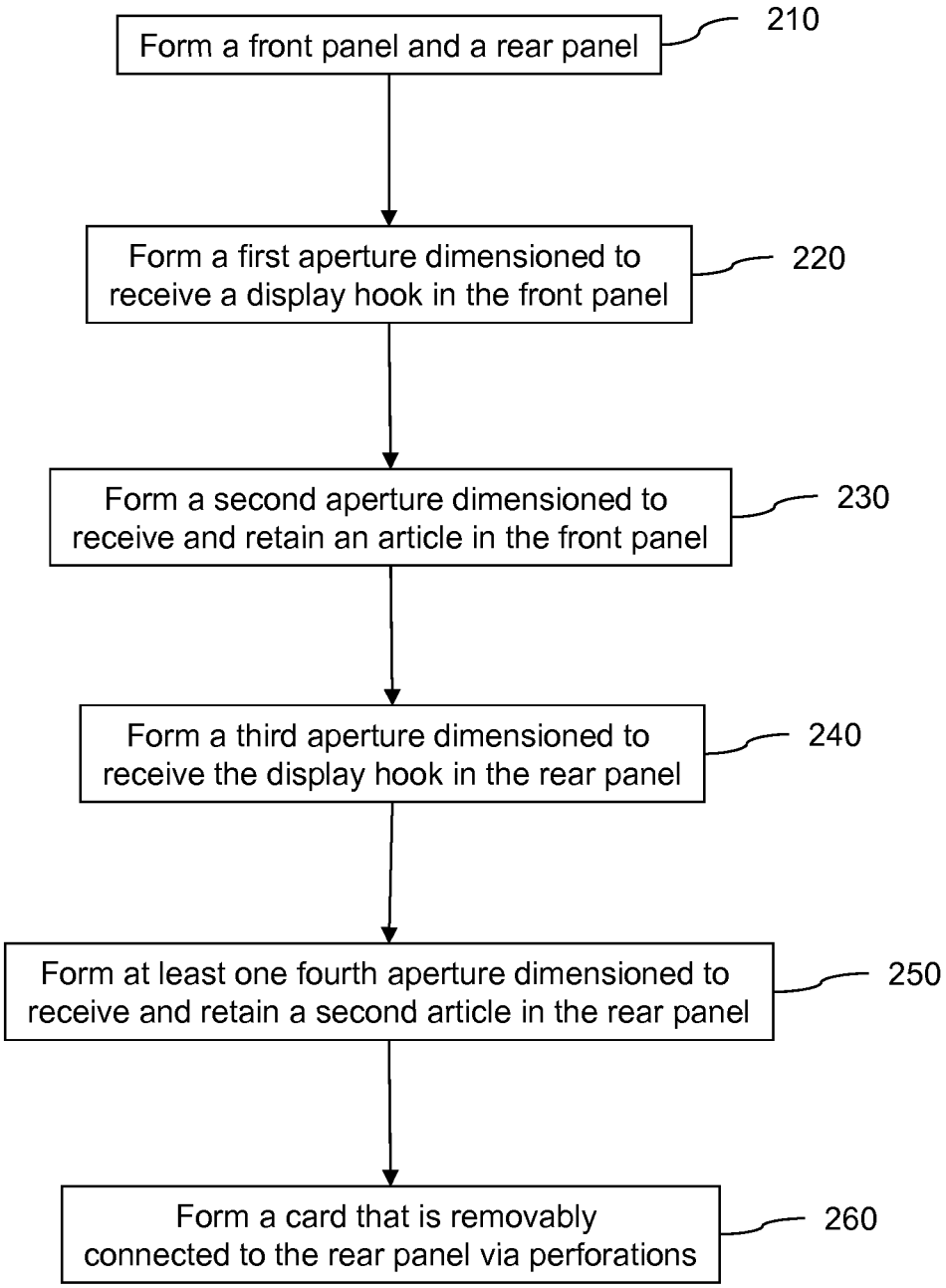
FIG. 5 is a flow diagram illustrating a method for forming a gift bag holder according to an embodiment of the invention.

FIG. 5 is a flow diagram illustrating a method for forming a device (e.g., the device 100) according to an embodiment of the invention. A front panel and a rear panel are formed 210. As described above, the device can be formed from a single sheet of material that is folded at the boundary between the front panel and rear panel. A first aperture dimensioned to receive a display hook is formed in the front panel 220. The first aperture is dimensioned to receive and retain a portion of a display hook therein, such that the display hook passes through the first aperture and secures the device and its contents thereon via friction.

A second aperture dimensioned to receive and retain an article is also formed in the front panel 230. This can include forming an elongated slit dimensioned to receive and retain a thin, flexible article. As described above, the second aperture can be formed below the first aperture so that the article(s) can hang downward and away from the display hook without obstruction.

A third aperture dimensioned to receive the display hook is formed in the rear panel 240. The third aperture is formed such that it is substantially equal in size and shape to the first aperture, and such that the third aperture is aligned with the first aperture when the device is in a folded configuration.

At least one fourth aperture dimensioned to receive and retain a second article is also formed in the rear panel 250. This can include forming a first opening and a second opening that are each dimensioned to receive and retain a drawstring for the article.

A card that is removably connected to the rear panel via perforations is formed 260. As described above, tearing or breaking of the perforations allows for the removal of the card from the rear panel. The card can be decorative such that when the device is used as a gift bag holder, the card includes an area for filling out the names of the recipient(s) of the gift and/or the sender(s) of the gift.

In at least one embodiment, the first aperture, second aperture, third aperture, at least one fourth aperture, and card are formed simultaneously; although it is recognized that one of ordinary skill in the art would understand based on this disclosure that the first aperture, second aperture, third aperture, at least one fourth aperture, and card can be formed in any order. In at least one embodiment, the first aperture, second aperture, third aperture, at least one fourth aperture, and perforations are stamped or otherwise cut out from the front panel.

Although specific example embodiments have been illustrated and described herein, those of ordinary skill in the art appreciate that other variations, aspects, or embodiments may be contemplated, and/or practiced without departing from the scope or the spirit of the appended claims.

The invention claimed is:

1. A device comprising:

a front panel including a first aperture and a second aperture, said first aperture is dimensioned to receive a display hook, and said second aperture comprises an elongated slit dimensioned to receive and retain an article; and a rear panel hingedly connected to said front panel, wherein a top of said front panel is in communication with a top of said rear panel, wherein a height of said rear panel is at least three times greater than a height of said front panel, said rear panel including a third aperture, and at least one fourth aperture, a first slit, and a second slit, said third aperture is dimensioned to receive the display hook, said at least one fourth aperture comprises a first opening and a second opening, wherein said first opening and said second opening are dimensioned to receive and retain a drawstring for the article, said first slit connects the first opening to an outer edge of said rear panel, and said second slit connects the second opening to said outer edge of said rear panel.

2. The device according to claim 1, wherein said elongated slit is dimensioned to receive and retain a thin, flexible article.

3. The device according to claim 1, wherein said third aperture is substantially equal in size and shape to said first aperture.

4. The device according to claim 1, wherein said third aperture is aligned with said first aperture when said device is in a folded configuration.

5. The device according to claim 1, further comprising a card removably connected to said rear panel via perforations.

6. The device according to claim 5, wherein said card is centered between a left edge of said rear panel and a right edge of said rear panel, and wherein said fourth aperture is positioned between said card and a right edge of said article.

7. The device according to claim 1, wherein said first aperture is positioned above said second aperture, and wherein said third aperture is positioned above said at least one fourth aperture.

8. The device according to claim 1, wherein said first slit connects said first opening of said fourth aperture to a right edge of said rear panel; and said second slit connects said second opening of said fourth aperture to said right edge of said rear panel.

9. The device according to claim 1, wherein a width of a bottom edge of said front panel is greater than a width of a bottom edge of said rear panel.

10. The device according to claim 1, wherein a width of said first opening of said fourth aperture is equal to a width of said second opening of said fourth aperture, wherein said width of said second opening is greater than said width of said drawstring.

11. The device according to claim 1, wherein said second opening of said fourth aperture is below said first opening of said fourth aperture and said first aperture.

12. The device according to claim 1, wherein said second aperture comprises a rectangular shape and lacks a flap.

13. The device according to claim 1, wherein said at least one fourth aperture lacks a flap.

14. The device according to claim 1, wherein a width of said second aperture is greater than a width of the article in a stored configuration, wherein the article in the stored configuration includes a thin flexible bag folded into a flat configuration.

15. The device according to claim 1, wherein said third aperture is positioned below said top of said front panel and above said at least one fourth aperture.

16. A device for holding a bag, said device comprising:

a front panel including a first aperture and a second aperture, said first aperture is positioned above said second aperture, said first aperture is dimensioned to receive a display hook, and said second aperture comprises an elongated slit dimensioned to receive and retain the bag;

a rear panel hingedly connected to said front panel, wherein a top of said front panel is in communication with a top of said rear panel, wherein a height of said rear panel is at least three times greater than a height of said front panel, said rear panel including a third aperture, at least one fourth aperture, a first slit, and a second slit, said third aperture is positioned above said at least one fourth aperture, said third aperture is dimensioned to receive the display hook, and said at least one fourth aperture comprises a first opening and a second opening, wherein said first opening and said second opening are dimensioned to receive and retain a drawstring for the bag, said first slit connects the first opening to an outer edge of said rear panel, and said second slit connects the second opening to said outer edge of said rear panel; and a card removably connected to said rear panel via perforations.

17. The device according to claim 16, wherein said third aperture is substantially equal in size and shape to said first aperture.

18. The device according to claim 16, wherein said third aperture is aligned with said first aperture when said device is in a folded configuration.

19. A method for forming a device, said method comprising:

forming a front panel and a rear panel, wherein a top of said front panel is in communication with a top of said rear panel, wherein a height of said rear panel is at least three times greater than a height of said front panel;

forming a first aperture dimensioned to receive a display hook in the front panel;

forming a second aperture comprising an elongated slit dimensioned to receive and retain a bag in the front panel;

forming a third aperture dimensioned to receive the display hook in the rear panel; and forming at least one fourth aperture dimensioned to receive and retain a drawstring for the bag in the rear panel, said forming of the at least one fourth aperture comprises forming a first opening, a second opening, a first slit, and a second slit, the first slit connects the first opening to an outer edge of the rear panel, and the second slit connects the second opening to the outer edge of the rear panel.

* * * * *